US006773271B2

(12) United States Patent
Falchetti

(10) Patent No.: US 6,773,271 B2
(45) Date of Patent: Aug. 10, 2004

(54) FUSE-HOLDING MODULAR STRUCTURE AND RELATIVE FUSE-HOLDING MODULE

(75) Inventor: Antonio Falchetti, Codogno (IT)

(73) Assignee: Heccanotecnica Codognese S.p.A., Codogno (IT)

( * ) Notice: Subject to any disclaimer, the term of this patent is extended or adjusted under 35 U.S.C. 154(b) by 69 days.

(21) Appl. No.: 10/328,834

(22) Filed: Dec. 24, 2002

(65) Prior Publication Data

US 2003/0153212 A1 Aug. 14, 2003

(51) Int. Cl.[7] ..... H01R 12/00
(52) U.S. Cl. ..... 439/76.2; 439/701
(58) Field of Search ..... 439/76.2, 622, 439/701, 717, 594, 544, 549, 552–553, 562, 563, 569, 135; 174/50, 58, 59

(56) References Cited

U.S. PATENT DOCUMENTS

| | | | | |
|---|---|---|---|---|
| 4,469,393 A | | 9/1984 | Chewning et al. | |
| 5,179,503 A | | 1/1993 | Fouts et al. | |
| 5,605,465 A | * | 2/1997 | Kobayashi et al. | 439/76.2 |
| 5,915,978 A | * | 6/1999 | Hayakawa et al. | 439/76.2 |
| 6,022,247 A | * | 2/2000 | Akiyama et al. | 439/701 |
| 6,027,360 A | * | 2/2000 | Jenkins | 439/364 |
| 6,126,458 A | * | 10/2000 | Gregory et al. | 439/76.2 |
| 6,196,882 B1 | * | 3/2001 | Sato et al. | 439/701 |

FOREIGN PATENT DOCUMENTS

| | | | |
|---|---|---|---|
| EP | 0732769 | 9/1906 | H01R/9/22 |
| EP | 0508059 | 10/1992 | H01H/85/20 |
| EP | 0 170 455 B1 | 4/1994 | |
| FR | 2742004 | 6/1997 | H01R/13/506 |
| WO | 9628861 | 9/1996 | H01R/13/514 |

* cited by examiner

*Primary Examiner*—P. Austin Bradley
*Assistant Examiner*—Felix O. Figueroa
(74) *Attorney, Agent, or Firm*—Notaro & Michalos P.C.

(57) ABSTRACT

Modular fuse-holding structure for an automobile consisting of a frame made of plastic material (1) in which a plurality of modules (6) are housed, individually attached to the frame, without mutual locks and capable of being composed according to requirements.

To ensure the holding of the devices (50, 56) for the snap attachment of the modules to the frame, the modules are equipped, on two opposite faces, with tenons (42, 44, 43, 45) which engage with rails formed inside two opposite side walls of the frame and which prevent the distancing of the opposite walls of the frame near to the snap attachment devices.

14 Claims, 3 Drawing Sheets

FIG. 2
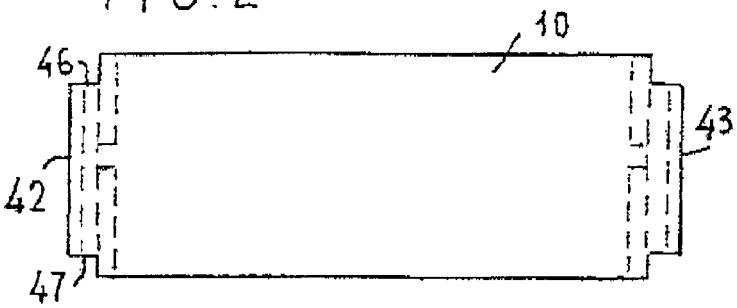
FIG. 3
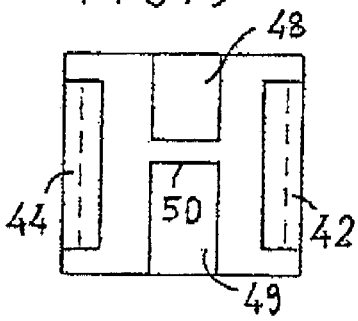
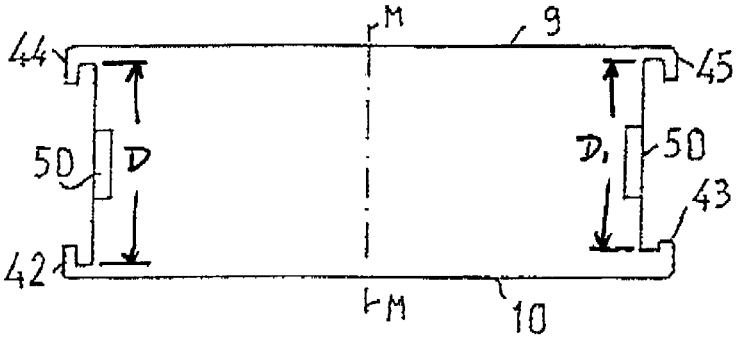
FIG. 4
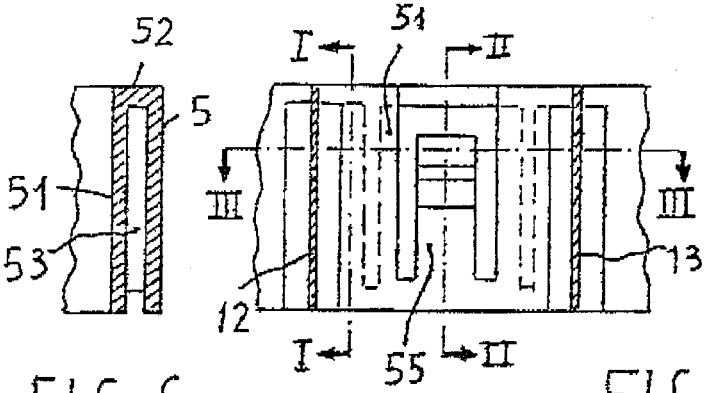
FIG. 6
FIG. 5
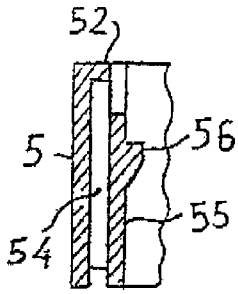
FIG. 7
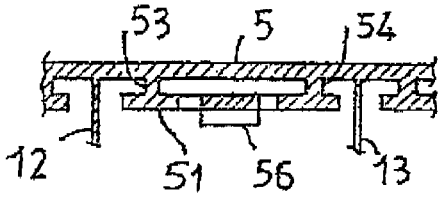
FIG. 8

FUSE-HOLDING MODULAR STRUCTURE AND RELATIVE FUSE-HOLDING MODULE

BACKGROUND OF THE INVENTION

1. Field of the Invention

The present invention relates to a housing and support structure for fuse-holding modules of the type intended for installation on vehicles, to receive in respective seats, formed in the modules, fuses, relays and similar electrical or electronic devices, as well as the necessary electrical connection terminations.

2. Description of the Related Art

To be able to satisfy different requirements with the same type of base components, groupable from time to time in different numbers or types, it has been known for some time to form these fuse-holding boxes as a structure in which many different rectangular parallelepiped-shaped fuse-holding modules are housed in a single container, or else, as described in EP-A-0508059 to compose the structure with a plurality of modules, each of which intrinsically forms a box, with a lid and a removable base, and is equipped, at its periphery, with fitting means and countermeans for removably attaching together the different modules and to thus form a unitary structure.

The same fitting means are used for the insertion of support rods or feet, through which the structure can be fixed through screws in the engine bay or on the shut-off partition between engine bay and passenger compartment. In the case of many fuse-holding modules housed in a single container, it has been proposed, like for example in EP-A-170455 to supply the different modules with fitting means for mutually attaching the different modules to each other, and then for attaching the set of modules inside a box.

For this purpose one or more modules can be supplied with screws for the fastening of the whole thing to the container.

In EP-A-170455 each module is equipped, on at least one side face, with overhanging tenons forming an interposed mortise having an undercut and with conjugated means (rod/groove) for the precise positioning of the two juxtaposed modules.

The conjugated means fit together two juxtaposed modules preventing any relative displacement of the modules in the juxtaposition plane and leaving only one degree of freedom: indeed, the modules are free to move away from each other.

A restriction which limits this degree of freedom is obtained with the use of a separate element of the tenon or double wedge type which simultaneously fits into the mutually interfacing mortises of the two juxtaposed modules and locks in position by effect of snap devices.

The construction of the structure is all the more laborious and requires different components.

From the constructive point of view the complexity of the profiles used to realize the coupling, besides involving a reduction in the useful volume of the module for housing the electrical components, involves a substantial fixed cost for the construction of the moulds necessary for production.

For the fixing of the whole of the modules to a support the use of auxiliary modules are foreseen fixed to the others with the same mutual attachment system and having through seats for fixing screws.

In fact manufacturing and assembling allowances may cause dimensional errors which do not allow for the use of the same mutual attachment system for a multiple and reliable fixing to a support or inside a container.

A similar approach, even if relatively simpler, is described in U.S. Pat. No. 4,469,393, which generally refers to modular connectors.

In U.S. Pat. No. 4,469,393 each module is equipped, on at least two side faces, with mating means (tenons on one face and mortise on the other) so that two modules can be fixed together inserting the tenon of one module into the mortise of the juxtaposed module.

Snap devices prevent the slipping of the tenon from the mortise.

The use of the coupling double wedge is thus eliminated, but not of the other elements, and for the fixing of the group of modules at least one dedicated module, equipped with a through-seat for fixing screws is necessary anyhow. In both cases the replacement of one module to remedy a possible malfunction or defect, or even only for reasons of updating and adaptation of the harness to new requirements, involves a laborious disassembly and decoupling operation of the different modules, besides the removal of the entire group of modules from the housing box or from the support.

The same drawback is present when the housing box is of a size and designed for allowing the addition of further optional modules, required only with the subsequent installation of accessories.

Also in this case it is necessary to remove the entire group of modules from the housing box, to couple the additional module with the pre-existing ones, possibly with a reconfiguration of them, and finally to put the whole thing back together again.

SUMMARY OF THE INVENTION

The present invention eliminates these drawbacks and provides a modular structure, consisting of a generically rectangular unitary frame, in which a plurality of parallelepiped rectangle-shaped fuse-holding modules, which are identical in size, with different functions according to requirements, are housed in the frame and directly removably fixed to it, without any mutual constraint, through a pair of opposite snap devices which engage two opposite faces of the module with two opposite walls of the frame.

In this way, still safeguarding the versatility of the structure, which can be adapted to the most diverse requirements, the construction and replacement operations of modules are made simpler and more reliable.

Also the structure of the individual modules is simplified, not being foreseen mutual coupling means which take up a certain amount of space, which cannot be used for the end use of the module, and a greater complexity of the production moulds, therefore a greater cost.

The frame is then equipped with a suitable number of feet or stirrups for fixing to the vehicle and lends itself in an extremely simple manner to the coupling with a protection cover and a base shell, together with which it goes to form a housing box for many fuse-holding modules.

Indeed, it is clear that to allow the insertion and the replacement of different electrical components in the modules, housed in the frame, said frame must be opened above and equipped with a removable cover for protecting the components from dust and possible sprays.

At the same time, to allow the insertion in the frame of different modules which, to avoid construction errors, generally come already wired, the base of the frame must be open, or else removably closed by a base shell equipped with suitable outlets for the passage of the electrical cables.

The frame, necessarily realised, like the cover and the base plate, in insulating material, preferably in thermoplastic material formed by injection moulding to combine the requirement of cost-effectiveness and ease of production with a good ability to elastically absorb knocks and stresses, cannot have a sufficient rigidity to guarantee the snap fixing of the modules onto its walls, even if the modules are fitted inside the frame.

The walls of the frame can deform elastically and, with respect to the desired configuration, can also be naturally deformed by effect of internal stresses which develop in the removal step from the mould and which are due to the shrinkage of the material as a consequence of local temperature differences. According to a further aspect of the present invention, this drawback, or rather the relative elasticity and deformability of the frame, is advantageously exploited and converted into an advantage which allows the clearances and productive allowances to be recovered, foreseeing, on the two opposite faces of the modules which have to be snap coupled with the walls of the frame, tenons which engage in corresponding seats of the walls of the frame, near to the snap fastening devices, and are capable of holding the walls of the frame in contact with the opposing faces of the modules, counteracting the stresses caused by the snap devices, and from possible internal stresses of the material which tend to move them apart.

BRIEF DESCRIPTION OF THE DRAWINGS

The advantages and the characteristics of the invention shall become clearer from the following description of a preferred embodiment, given with reference to the attached drawings in which:

FIGS. 2, 3, 4 are a front, side and top view, respectively, of a fuse-holding module for the structure of FIG. 1, FIG. 5 is a front view, from the inside, of a portion of a longer wall of a frame for the structure of FIG. 1, FIGS. 6, 7, 8 are section views of the portion of wall of FIG. 5, according to the views I—I, II—II and III—III of FIG. 5, respectively.

DETAILED DESCRIPTION OF THE PREFERRED EMBODIMENT

Figure 1:
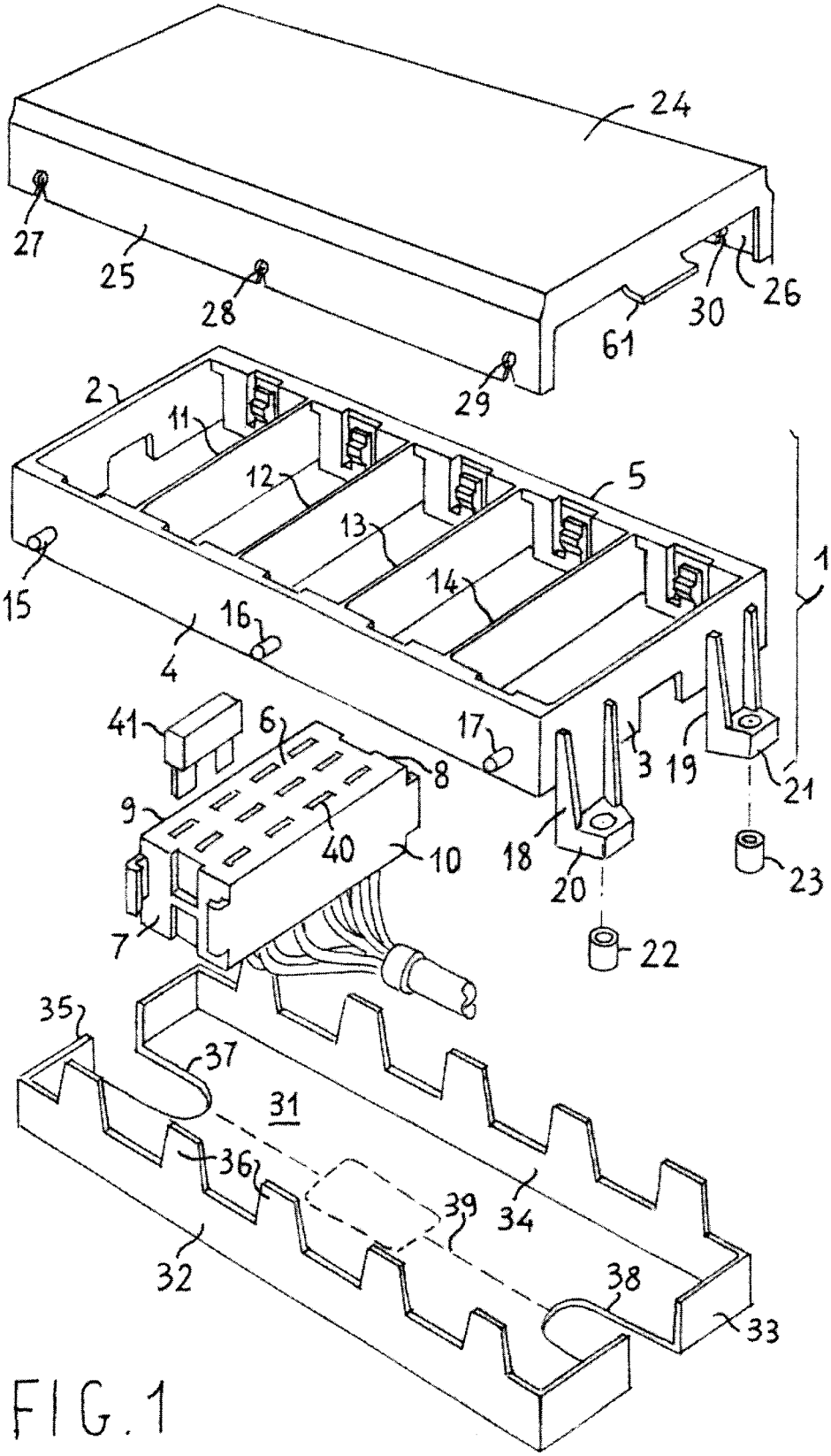
FIG. 1 is an overall exploded perspective view of the modular structure object of the present invention.

With reference to FIG. 1 a modular fuse-holding structure according to the present invention comprises a substantially flat rectangular frame 1, formed by two pairs of opposite walls 2, 3, 4, 5, perpendicular to the plane of the frame, and a plurality of fuse-holding modules 6, only one of which is represented, housed inside the frame.

The fuse-holding modules are parallelepiped rectangle-shaped, with an upper face, a lower face, two shorter opposite side walls 7, 8 and two longer opposite side walls 9, 10.

The two longer opposite side walls 9, 10 are substantially flat, without raised parts which could prevent by interference the relative sliding, in any direction in the plane of the walls, between modules juxtaposed along said longer walls.

This does not exclude the possible presence, in these walls, of recesses or functional openings for the specific tasks which the modules must carry out, for example for the insertion of locking devices, primary and/or secondary of electrical terminals housed in the module, devices which are per se known.

The upper and lower face of the module, like its internal structure, are conventional and do not require explanation. It should only be noted that in relation to the specific function suitably arranged openings and inner housings are foreseen.

For example, in FIG. 1, the module 6 has openings 40, on the upper face, to receive the contact blades of blade fuses, exemplified by the fuse 41. Inside the module, housings are present, not shown, for receiving electrical terminals of cables 42, which are inserted into the module through openings present in the lower face.

The distance between the shorter opposite side walls 7, 8 of the modules (that is in practice the width of the opposite side walls 9, 10) is substantially equal to or a little less than the distance between the two opposite side walls 4, 5 of the frame, so that the modules can be freely inserted into the frame, juxtaposed with each other without mutual constraints.

The frame 1 can be equipped with partition walls 11, 12, 13, 14, parallel to the shorter opposite side walls 2, 3 and at a distance substantially equal to or a little greater than the distance between the longer opposite side walls 9, 10 of the modules.

These partition walls, if present, contribute to a certain extent to ensuring a certain rigidity of the frame and in particular limit the bending of the walls 4, 5 caused by the internal stresses which develop in the step of removal from the mould.

Moreover, they form prismatic housings in which the different modules can be inserted, individually or in groups, from the lower side of the frame. Before considering in detail how the different modules are removably fixed to the frame 1, independently from each other, it is appropriate to conclude the description of FIG. 1.

The longer walls 4, 5 of the frame 1 are equipped on the outside with a plurality (at least 2) of cylindrical pins 15, 16, 17, formed integrally with the walls.

The shorter walls 2, 3 of the frame, are equipped on the outside with brackets 18, 19, reinforced by ribs and obtained integrally with the walls, suitably extending below the frame and ended with feet 20, 21 for resting on and attaching to a support. For this purpose the resting feet 20, 21 (the corresponding resting feet extending from the wall 2 are only partially visible) are equipped with a cylindrical seat in which is force-fitted a metallic bushing, 22, 23 respectively, which has the function of limiting the compression, exerted upon the plastic material of the foot, by a screw (or locking nut) which fixedly attaches the frame to a support.

In relation to the foreseen specific application (fuse-holding box for an automobile) it is, indeed, necessary to ensure a reliable attachment also in the presence of vibrations and temperature changes. This is obtained by exploiting the combined effect of the metallic ferrule and of the plastic material: on one side the ferrule ensures a rigid locking, on the other the suitably compressed plastic material constitutes, with a permanent contact pressure and the consequent friction developed, a sort of anti-unscrewing gasket.

The frame 1 can be closed above by a cover 24, partially fitted on the walls of the frame 1 (which for this purpose can be tapered above).

The cover 24 is equipped with two opposite side walls 25, 26 which overlay one another outside of the walls 4, 5 of the frame and are equipped with resilient seats 27, 28, 29, 30, with a notch for the snap insertion of the pins 15, 16, 17.

A pair of axially aligned pins, arranged on the opposite walls of the frame, like for example the pins 15 and the opposite pin which cannot be seen, can constitute, for the cover 24, a hinged attachment and can allow its opening by rotation, without the need for a complete removal.

To ease the operation the cover can be equipped with a grip tab 61 or another equivalent means.

For a better seal against dust and sprays, the cover 24 can also be equipped inside with a resilient gasket, not illustrated, which engages on the upper edge of the walls of the frame.

Finally, the frame can be closed below by a shell 31, equipped with side walls 32, 33, 34, 35 which overlay or insert, with their edge, to or in the lower edge of the walls of the frame.

The opposite side walls 32, 34 can be suitably equipped with tabs 36 which insert into corresponding seats formed inside the walls 4, 5 of the frame 1 and, besides ensuring the coupling of the plate 31 to the frame, advantageously carry out, as we shall see, the function of secondary lock for the attachment devices of the modules 6 to the frame 1.

Clearly, the shell 31, if foreseen, is supplied with peripheral outlets 37, 38, suitably arranged, according to requirements, for the passage of the wirings and possibly can be split into two half-shells, coupled for example according to the dividing line 39, so as to obtain through-openings for the wirings inside the shell.

Let us now examine, with reference to FIGS. 2, 3, 4, the attachment devices foreseen in the modules 6 for the removable and individual attachment of each of the modules to the frame 1.

The module 6 is equipped at the ends of the longer side walls 9, 10, with appendages 42, 43, 44, 45, bent into an L-shape towards each other, which extend protruding with respect to the shorter side walls and form on these walls two pairs of opposite tenons, extending between the lower and upper wall, with an interposed mortise.

The top 46, 47 of the tenons, preferably lower with respect to the plane of the upper face of the module, forms an abutment shoulder.

Advantageously, but not necessarily, the lower end of the tenons 47, is raised with respect to the lower face of the module, for reasons which we shall see.

In each of the shorter side walls of the module, in an intermediate position, two vertical grooves 48, 49 are formed, aligned vertically and separated by a locking tooth 50, intended to snap engage with an elastic harpoon formed in the walls of the frame.

The realization of these elements, integrally with the module, by molding of thermoplastic material, is extremely simple and does not substantially worsen the construction costs of the moulds. Moreover, since there are no undercuts, these elements can be obtained simply with a mould and countermould, without complications.

FIG. 5 represents in a front view from the inside of the frame, a portion of one of the longer side walls 4, 5 of the frame, corresponding to little more than the width of a module, to illustrate in detail a device for fixing the modules.

FIGS. 6, 7, 8 represent for greater clarity the portion of FIG. 5 in a section view according to the views I—I, II—II, III—III of FIG. 5, respectively.

Clearly, the structure represented is repeated on the side walls of the frame according to the number of modules which have to be housed in the frame, for example 5, as represented in FIG. 1.

Clearly, the frame can be sized according to requirements, to house a different number of modules, for example only three, or even 4, 6, 7 or 8 modules.

With reference to FIGS. 5 to 8 the opposite walls 4, 5 of the frame consist of a continuous outer wall 5 and of a plurality of inner plates, only one 51 of which is represented, parallel to the first wall and separated from it by an interspace with a thickness equal to or little greater than the thickness of the tenons of the modules (FIGS. 2: 42, 43, 44, 45).

The inner plate 51 is connected to the outer wall 5 by a continuous upper edge 52, as well as by vertical ribs 53, 54.

The inner plate 51 has a width equal to or little less than the width of the modules, shortened by the thickness of the tenons, and forms a rail or T-shaped tenon with parallel sides on which attaches, by sliding insertion, on the lower side of the frame, a pair of tenons of a module.

The L-configuration of the tenons and the T-configuration of the rail allows a precise coupling to be obtained with minimum clearance.

The depth of insertion is defined by the shoulder 46 of the tenons, which rests upon the inner wall of the upper edge 52.

To attach the module to the frame so that said module can slide the plate 51 is equipped, in its intermediate portion formed integrally with the plate, with a cantilevered vertical tab 55 (that is a tab which extends perpendicular to the plane of the frame), supported by the lower part of the plate and equipped with a tooth 56 which is raised with respect to the plane of the plate 51, on the opposite side to the outer wall 5.

The lower side of the tooth 56 is advantageously inclined.

Although not indispensable, as already stated, at the sides of the plate 51, conveniently distanced from it, vertical plates 12, 13 can be foreseen which extend from the outer wall 5 up to the opposite outer wall of the frame and form a housing of a width equal to that of a module.

During the course of the insertion of the tenons of a module on the sides of the rail consisting of the plate 51, the tooth 56 slides freely in the vertical groove 48 of the module, until the tooth 56 does not interfere with the locking tooth 50 of the module.

The interference of the tooth 50 with the side of the tooth 56, causes the flexing of the tab 55, which approaches the outer wall 5 and allows the tooth 50 to get past the tooth 56 with the further insertion of the module.

With the module completely inserted, when the shoulder 46 abuts with the inner wall of the upper edge 52 of the frame, the interference between the two teeth 50, 56 ends and the tab 55 can snap and return to the nondeformed rest position.

In this state the locking tooth 50, which has by-passed the tooth 56, ensures a univocal and stable relative position between module and frame and prevents, by interference, the withdrawal of the module from the frame.

The withdrawal is only made possible by a purposefully caused flexing of the tab 55, for this purpose equipped with an attachment 57 which can be accessed through the upper groove 48 of the module and which can be accessed with a common tool, for example a screwdriver.

Clearly, the described structure, which refers to one wall of the frame, is also present in the opposite wall.

In this way the tenons on the opposite walls of the module which hook onto the rail of the opposite walls 4, 5 of the frame near to the snap sealing devices on one side and on the other, respectively, of said devices, prevent the mutual distancing of the opposite walls of the frame, independently from the possible presence of the plates like 11, . . . 14 (FIG. 1) and allow possible clearances due to production allowances or to deformations caused by the removal of the frame from the moulds to be recovered, ensuring the precise positioning of the walls of the frame with respect to those of the module and with that the effectiveness of the lock consisting of the interference of the locking tooth 50 with the tooth 56.

Figure 9:
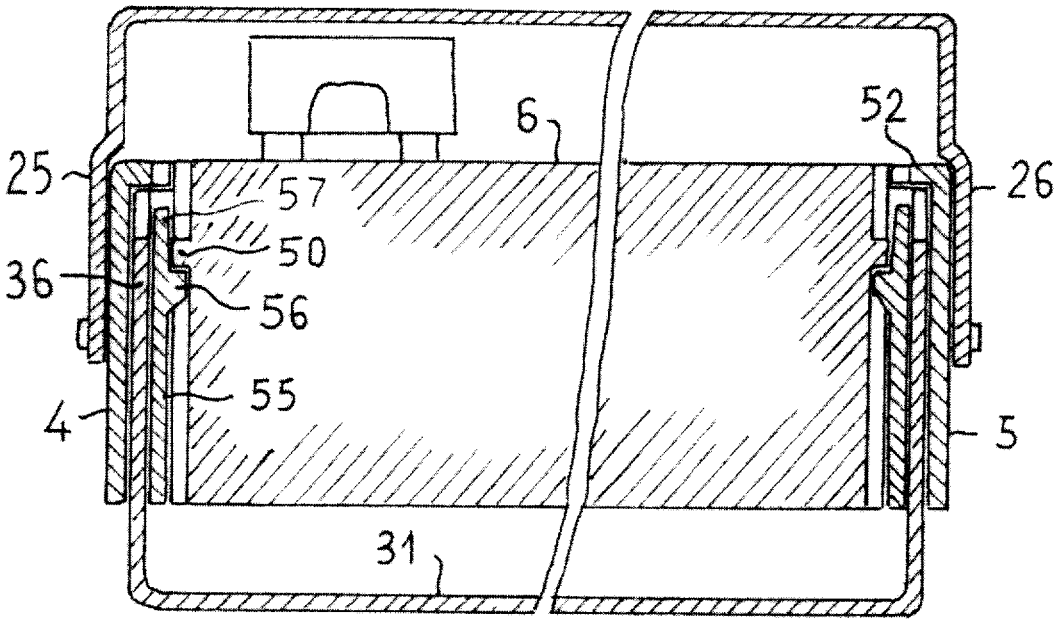
FIG. 9 is an overall section view of the modular structure of FIG. 1, according to the view II—II of FIG. 5.
Figure 10:
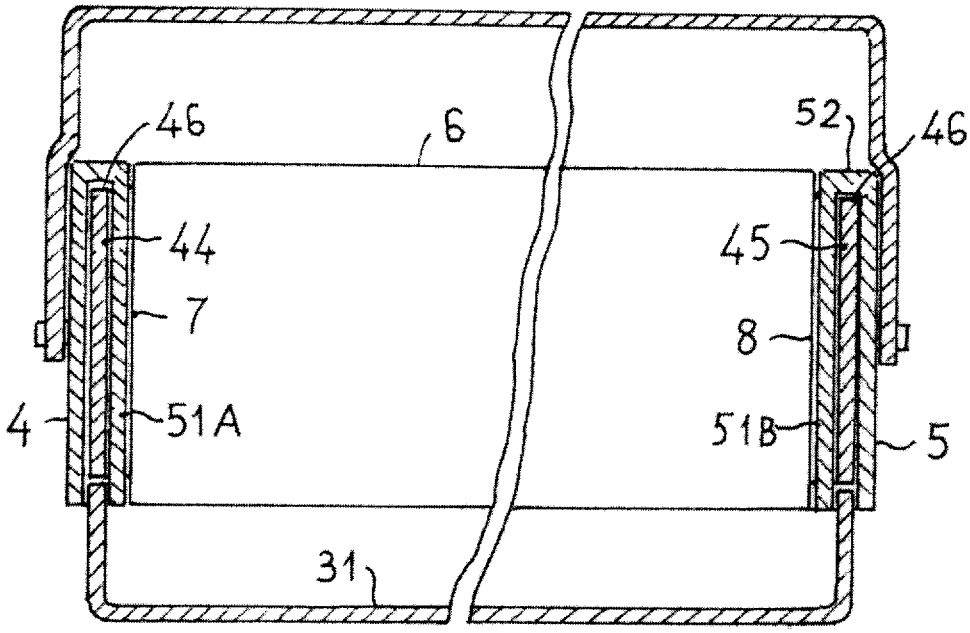
FIG. 10 is an overall section view of the modular structure of FIG. 1, according to the view I—I of FIG. 5.

For greater clarity FIGS. 9, 10 represent in section views, according to the sections II—II and I—I of FIG. 5, respectively, the entire modular structure object of the present invention.

In the figures a module 6 is housed between the opposite walls 4, 5 of the frame with the opposite walls 7, 8 of the module in contact with the inner plates 51A, 51B, respectively, integral with the opposite walls 4, 5 of the frame.

The walls 4, 5 are firmly held at a predetermined distance, without the possibility of moving apart, by the engagement of tenons 44, 45 of the module with the sides of the rail consisting of the plates 51A, 51B.

The vertical positioning of the module relative to the frame, is ensured on both sides of the module, by the resting of the abutment shoulder 46 of the tenons against the upper edge 52 of the frame.

The holding of the vertical position thus defined is ensured on both sides by the interference of the locking teeth 50 of the module, with the retaining teeth 56. Since the distancing of the side walls 4, 5 is prevented by the engagement of tenons 44, 45, the interference of the teeth 50 and 56 is ensured in a reliable manner, also in the presence of external stresses.

Moreover, advantageously, the tabs 36 with which can be equipped the shell 31 for closing the frame below, inserted between the tabs 55 of the frame and the opposite walls 4, 5, constitute effective secondary locks which prevent the flexing of the tabs 55 and the intentional or accidental disengagement of the teeth 50, 56.

The intentional disengagement can only take place with the removal of the lower plate 31 and with an intervention, through a tool, on the attachment 57 of the tab 55 to elastically flex the tab and to unlock the tooth 56 from the tooth 50.

The frame is closed above by the cover 24, the opposite side walls 25, 26 of which are fitted on the opposite walls 4, 5 of the frame.

In the same way the frame is closed below by the shell 31, the opposite side walls 32, 34 of which partially fit into the interspace between the plates 51A, 51B and the outer walls 4, 5 of the frame.

In FIGS. 2, 3, 4 the modules are externally symmetrical with respect to their median section M—M.

Their insertion into the frame can thus take place indifferently with two different arrangements relative to the frame, rotated by 180° with respect to each other.

If for particular reasons it is appropriate that the arrangement in the frame be determined in just one way, the modules and the walls of the frame can be "polarized" so as to ensure a single relative arrangement.

For example, the distance D between the tenons 42, 44 (FIG. 4) extending on one face of the module, can be different to the distance $D_1$ between the tenons 43, 45 extending on the opposite face, with a corresponding difference in the width of the rail, on the opposite walls of the frame, with which they have to couple.

Alternatively, the shoulder 46, with which the tenons are equipped, can be arranged at a different height, with a corresponding variation of the thickness of the upper edge of the walls of the frame, with which they have to abut.

In this case a mistaken arrangement of the module in the frame is recognized by the interference of the tenons with the upper edge which precludes the complete insertion of the modules and the snap of the holding devices.

In any case the polarization can be obtained without constructive complications and without additional elements.

It is clear that many other variants can be brought.

For example the brackets 18, 19 (FIG. 1), with feet for attachment to a support, can extend from the longer walls 4, 5, instead of from the shorter ones.

Also the cantilevered tabs 55, instead of extending from the lower side of the plate 51, towards the upper edge 52, can be supported cantilevered by the upper edge 52, or can even be supported at both ends, like leaf springs.

What is claimed is:

1. Fuse-holding modular structure comprising:

a flat rectangular frame (1), molded in thermoplastic material, with two longer opposite side walls (4, 5) and two shorter opposite side walls (2, 3) perpendicular to the plane of the frame and forming a housing space for a plurality of modules, said longer side walls being equipped inside with a plurality of plates (51), parallel to and distanced from said longer side walls, fixedly connected to said longer side walls by a continuous upper edge (52) of said longer side walls and by a plurality of ribs perpendicular to the plane of the frame, in each of said plates, (51) being formed, in its median section, an elastic tab (55) with a retaining tooth (56), each of said plates forming a rail extending perpendicular to the plane of the frame, for the sliding attachment with corresponding tenons of a module, and a plurality of fuse-holding modules (6) with a parallelepiped rectangle-shaped body, in plastic material, with an upper and lower face, two longer opposite side walls (9, 10) and two shorter opposite side walls (7, 8), the distance between said shorter side wals being equal to the distance between two opposite plates (51) of said longer side walls (4, 5) of the frame (1), said modules (6) being equipped, each of said shorter side walls (7, 8) with:

a pair of tenons (42, 44; 43, 45), extending between the lower and upper face of the module and slidably engaged with one of said rails formed by said plates (51), shoulder means (46) which define, by interference with said frame (1), the relative positioning between module and frame in the direction perpendicular to the plane of the frame, and a lacking tooth (50) which ensures, by interference with said retaining tooth (56), the removable locking of the module in the frame.

2. Structure according to claim 1 wherein said longer side walls (4, 5) of the frame (1) are interconnected by one or more transversal partition walls (11, 12, 13, 14) parallel to said shorter side walls (2, 3) of the frame (1).

3. Structure according to claim 2 wherein at least a pair of said opposite side walls of the frame is equipped with brackets (18, 19) each with a foot (20, 21) for resting on and attachment to a support.

4. Structure according to claim 3 wherein said resting foot (20, 21) is equipped with a cylindrical seat in which a metallic bushing (22, 23) is force-fitted.

5. Structure according to claim 4 comprising a cover (24) with two opposite side walls (25, 26) juxtaposed on the outside of said longer side walls (4, 5) of the frame and equipped with grooves (27, 28, 29, 30) for the snap insertion of corresponding pins (15, 16, 17) formed outside of the longer side walls (4, 5) of the frame (1).

6. Structure according to claim 5 comprising a shell (31) for closing the bottom of said frame, the longer side walls of the shell being equipped with a plurality of tabs (36) which are inserted between said longer side walls (4, 5) of the frame and the corresponding inner plates (51), with the function of a secondary lock for said retaining teeth (56).

7. Structure according to claim 1 wherein at least a pair of said opposite side walls of the frame is equpped with brackets (18, 19) each with a foot (20, 21) for resting on and attachment to a support.

8. Structure according to claim 7 wherein said resting foot (20, 21) is equipped with a cylindrical seat in which a metallic bushing (22, 23) is force-fitted.

9. Structure according to claim 8 comprising a cover (24) with two opposite side walls (25, 26) juxtaposed on the outside of said longer side walls (4, 5) of the frame and equipped with grooves (27, 28, 29, 30) for the snap insertion of corresponding pins (15, 16, 17) formed outside of the longer side walls (4, 5) of the frame (1).

10. Structure according to claim 9, comprising a shell (31) for closing the bottom of said frame, the longer side walls of the shell being equipped with a plurality of tabs (36) which are inserted between said longer side walls (4, 5) of the frame and the corresponding inner plates (51) with the function of a secondary lock for said retaining teeth (56).

11. Structure according to claim 1 comprising a cover (24) with two opposite side walls (25, 26) juxtaposed on the outside of said longer side walls (4, 5) of the frame and equipped with grooves (27, 28, 29, 30) for the snap insertion of corresponding pins (15, 16, 17) formed outside of the longer side walls (4, 5) of the frame (1).

12. Structure according to claim 2 comprising a cover (24) with two opposite side wails (25, 26) juxtaposed on the outside of said longer side walls (4, 5) of the frame and equipped with grooves (27, 28, 29, 30) for the snap insertion of corresponding pins (15, 16, 17) formed outside of the longer side walls (4, 5) of the frame (1).

13. Fuse-holding module for a modular structure comprising a flat rectangular frame (1), molded in thermoplastic material, with two longer opposite side wails (4, 5) and two shorter opposite side walls (2, 3) perpendicular to the plane of the frame and forming a housing space for a plurality of modules, said longer side walls being equipped inside with a plurality of plates (51), parallel to and distanced from said longer side walls, fixedly connected to said longer side walls by a continuous upper edge (52) of said longer side walls and by a plurality of ribs perpendicular to the plane of the frame, in each of said plates (51) being formed, in its median section, an elastic tab (55) with a retaining tooth (56), each of said plates forming a rail extending perpendicular to the plane of the frame, for the sliding attachment with corresponding tenons of a module, said fuse holding module having a parallelepiped rectangle-shaped body made of plastic material, with an upper and lower face, longer opposite side walls (9, 10) and two shorter opposite side walls (7, 8), where said two longer opposite side walls (9, 10) can be juxtaposed, without mutual interference, with relative freedom to slide in any direction in the plane of said two walls (9, 10), with the shorter side walls (7, 8) of other modules of the same type, said module comprising, on each of said shorter side walls (7, 8), two parallel opposite tenons (42, 44; 43, 45) extending between the upper and lower face of the module, bent towards each other in an L-shape to form an interposed mortise in undercut for the slidable fixed joint coupling with a rail formed on both of the opposite walls of said frame, said tenons being equipped with a shoulder (46) interacting with a stop of said frame to define a relative position between said module and said frame, a groove (48, 49) extending between said upper and lower faces and interposed between said opposite tenons, and a stop tooth (50) in an intermediate position of said groove, for interaction with an elastic snap locking device of said frame, which keeps the module in said relative position.

14. Fuse-holding module according to claim 7 comprising polarization means of said shorter side walls of the module.

* * * * *

UNITED STATES PATENT AND TRADEMARK OFFICE

CERTIFICATE OF CORRECTION

PATENT NO. : 6,773,271 B2
DATED : August 10, 2004
INVENTOR(S) : Antonio Falchetti It is certified that error appears in the above-identified patent and that said Letters Patent is hereby corrected as shown below:

Title page,
Item [73], Assignee, correct the spelling of the assignee as follows:
-- Meccanotecnia Codognese S.p.A. --
Item [65], Prior Publication Data, insert missing priority information as follows:
-- EP 02425076.3 of February 14, 2002 --

Signed and Sealed this

Fourteenth Day of December, 2004

JON W. DUDAS
*Director of the United States Patent and Trademark Office*

UNITED STATES PATENT AND TRADEMARK OFFICE

CERTIFICATE OF CORRECTION

PATENT NO. : 6,773,271 B2
DATED : August 10, 2004
INVENTOR(S) : Antonio Falchetti It is certified that error appears in the above-identified patent and that said Letters Patent is hereby corrected as shown below:

Title page,
Item [73], Assignee, should read as follows:
-- Meccanotecnica Codognese S.p.A. --

Signed and Sealed this

Twenty-second Day of March, 2005

JON W. DUDAS
*Director of the United States Patent and Trademark Office*